US007396093B2

(12) United States Patent
Jeong et al.

(10) Patent No.: US 7,396,093 B2
(45) Date of Patent: Jul. 8, 2008

(54) REFRIGERATOR HAVING BASKET LIFT APPARATUS

(75) Inventors: Kyung-Han Jeong, Seoul (KR); Sang-Oh Kim, Seoul (KR); Seung-Hwan Oh, Gyeonggi-Do (KR)

(73) Assignee: LG Electronics Inc, Seoul (KR)

( * ) Notice: Subject to any disclaimer, the term of this patent is extended or adjusted under 35 U.S.C. 154(b) by 222 days.

(21) Appl. No.: 11/178,438

(22) Filed: Jul. 12, 2005

(65) Prior Publication Data

US 2006/0043848 A1 Mar. 2, 2006

(30) Foreign Application Priority Data

Jul. 29, 2004 (KR) ..... 10-2004-0059927

(51) Int. Cl.
*A47B 88/00* (2006.01)

(52) U.S. Cl. ..... 312/402; 312/310

(58) Field of Classification Search ..... 312/309, 312/310, 319.5, 319.7, 401, 402, 404, 405, 312/306, 312; 62/377, 382, 440; 108/72; 248/128, 132, 150, 151, 165, 166, 351
See application file for complete search history.

(56) References Cited

U.S. PATENT DOCUMENTS

| | | | | |
|---|---|---|---|---|
| 2,798,640 | A * | 7/1957 | Coddington | 312/306 |
| 2,866,677 | A * | 12/1958 | Anderson | 312/301 |
| 2,926,507 | A * | 3/1960 | Ingolia | 62/377 |
| 4,828,342 | A * | 5/1989 | Stefan | 312/223.3 |
| 5,115,822 | A * | 5/1992 | Nichols | 134/135 |
| 5,415,010 | A * | 5/1995 | Woo | 62/258 |
| 5,586,816 | A | 12/1996 | Geiss, II | |
| 6,510,858 | B1 * | 1/2003 | Halstead et al. | 134/57 D |
| 2005/0073225 | A1 * | 4/2005 | Kwon et al. | 312/402 |

FOREIGN PATENT DOCUMENTS

| | | |
|---|---|---|
| AU | 2004 4242445 | 2/2006 |
| JP | 1-106894 | 7/1989 |
| JP | 4-359781 | 12/1992 |

(Continued)

OTHER PUBLICATIONS

U.S. Appl. No. 11/178,451 to Lee et al., which was filed Jul. 12, 2005.

(Continued)

*Primary Examiner*—James O Hansen
(74) *Attorney, Agent, or Firm*—Greenblum & Bernstein, P.L.C.

(57) ABSTRACT

A refrigerator having a basket lift apparatus that improves convenience by raising a basket provided at a lower portion of a body. The refrigerator includes a refrigerator body having cooling chambers; a frame slidingly received in a cooling chamber provided at a lower portion of the body; a basket on the frame for storing food items; a door hingedly connected to the front of the frame; a first link, one side of the first link rotatably connected to the basket or the frame and the other side slidably coupled with the frame or the basket; a second link provided across the first link, one side of the second link rotatably connected to the basket or the frame and the other side slidably coupled with the frame or the basket; and a link drive unit.

7 Claims, 13 Drawing Sheets

FOREIGN PATENT DOCUMENTS

| | | | |
|---|---|---|---|
| JP | 04-359781 | * | 12/1992 |
| JP | 5-296647 | | 11/1993 |
| KR | 10-1998-026269 | | 7/1998 |
| KR | 2003-0000632 | | 1/2003 |

OTHER PUBLICATIONS

U.S. Appl. No. 11/178,452 to Oh et al., which was filed Jul. 12, 2005.
U.S. Appl. No. 11/101,584 to Oh et al., which was filed Apr. 8, 2005.
U.S. Appl. No. 11/104,539 to Oh et al., which was filed Apr. 13, 2005.
English language Abstract of JP 5-296647.
English language Abstract of KR 10-1998-026269.
English Language Abstract of JP 5-296647.
English language Abstract of JP 4-359781.
English Language Abstract of KR 2003-0000632.

* cited by examiner

REFRIGERATOR HAVING BASKET LIFT APPARATUS

BACKGROUND OF THE INVENTION

1. Field of the Invention

The present invention relates to a refrigerator having a basket lift apparatus, and particularly, to a refrigerator having a basket lift apparatus capable of improving convenience for a user by lifting a basket when the basket received in a lower portion of a body is taken out.

2. Description of the Background Art

FIG. 1 is a perspective view of a refrigerator in accordance with the conventional art, and FIG. 2 is a sectional view of a refrigerator showing that a basket is received in a body.

The conventional refrigerator includes: a body 1 whose front is open and which has a receiving space; an upper cooling chamber 3 disposed at an upper side of the body 1, having a pair of upper doors 2 opened in both directions, and storing food items; and a lower cooling chamber 6 disposed at a lower side of the body 1, separated from the upper cooling chamber 3 by a partition wall 4, and having a lower door 5 which is slidingly opened.

And, a machine room 8 having therein a compressor 7 and the like for generating cool air to be supplied to the upper cooling chamber 3 and the lower cooling chamber 6 is formed at the rear of the body 1.

A basket 9 for receiving frozen food items is disposed at the lower cooling chamber 6 and can slide in the front and rear direction (back and forth). The lower door 5 is fixed at the front of the basket 9. A user pulls the lower door 5 to open the basket 9 and pushes it to close the basket 9. Here, a guide rail 10 is installed between the basket 9 and an inner surface of the lower cooling chamber 6 and guides the basket to allow the basket 9 to slide in the front and rear direction (back and forth).

And, a plurality of drawers 11 which are slidingly opened and store food items are provided above the basket 9.

In the refrigerator in accordance with the conventional art having such a structure, when a user pulls the lower door 5 frontward in order to take out food items from the lower cooling chamber 6 or to put the food items therein, the basket 9 is slid and opened. And, when the lower door 5 is pushed rearward after the food items are taken out of the basket 9 or received therein, the basket 9 is slid and closed.

However, since the refrigerator in accordance with the conventional art having such a structure has a basket at its lower portion (i.e., the basket is installed at a lower side), a user has to stoop or crouch down to put in and/or take out food items into and/or from the basket, which causes inconvenience for the user.

SUMMARY OF THE INVENTION

Therefore, an object of the present invention is to provide a refrigerator having a basket lift apparatus capable of improving convenience for the user by lifting up a basket when the basket disposed at a lower portion of a body is opened.

To achieve these and other advantages and in accordance with the purpose of the present invention, as embodied and broadly described herein, there is provided a refrigerator comprising: a refrigerator body having cooling chambers; a frame slidingly received in a cooling chamber disposed at a lower portion of the body; a basket put on the frame and storing food items; a door positioned at the front of the frame and hingedly connected to the frame; a first link, one side of the first link being rotatably connected to the basket and the other side being slidably coupled with the frame; a second link disposed across the first link, one side of the second link being rotatably connected to the basket and the other side being slidably coupled with the frame; and a link drive unit connected to the first link or the second link and driving the link to allow the basket to ascend with respect to the frame.

To achieve these and other advantages and in accordance with the purpose of the present invention, as embodied and broadly described herein, there is provided a refrigerator comprising: a refrigerator body having cooling chambers; a frame slidingly received in a cooling chamber disposed at a lower portion of the body; a basket put on the frame and storing food items; a lower door positioned at the front of the frame and rotatably connected to the frame; a first link, one side of the first link being rotatably coupled with the frame and the other side being rotatably coupled with the basket; a second link disposed across the first link, one side of the second link being rotatably coupled with the basket and the other side being slidably coupled with the frame; a connection link, one side of the connection link being connected to the lower door and the other side being connected to the first link; and a fixing unit installed at the lower door and fixing the lower door to a specific position.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plurality of embodiments of a refrigerator having a basket lift apparatus in accordance with the present invention may exist, and hereinafter, the most preferred embodiment will be described.

Figure 1:
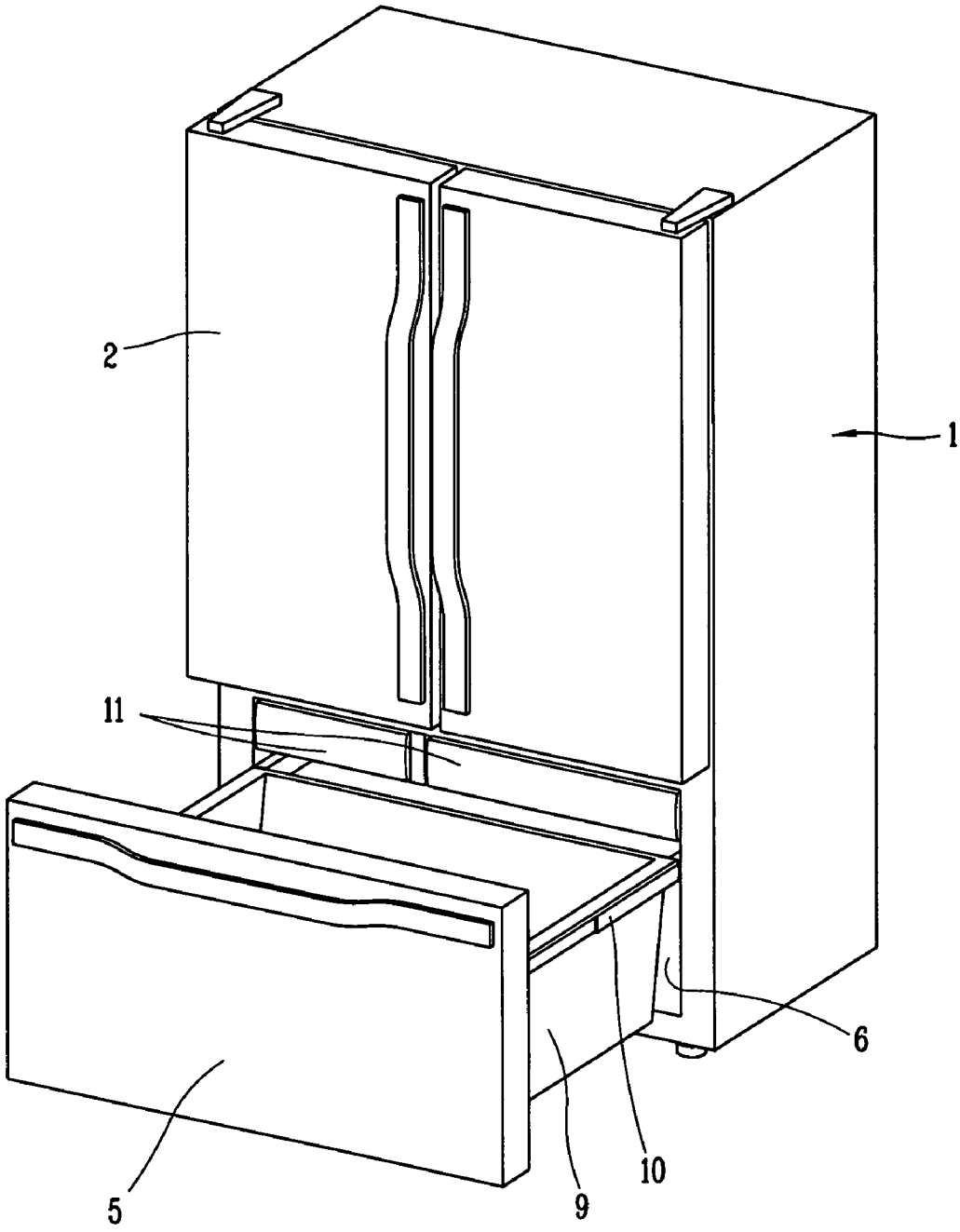
FIG. 1 CONVENTIONAL ART
FIG. 1 is a perspective view of a refrigerator in accordance with the conventional art.
Figure 2:
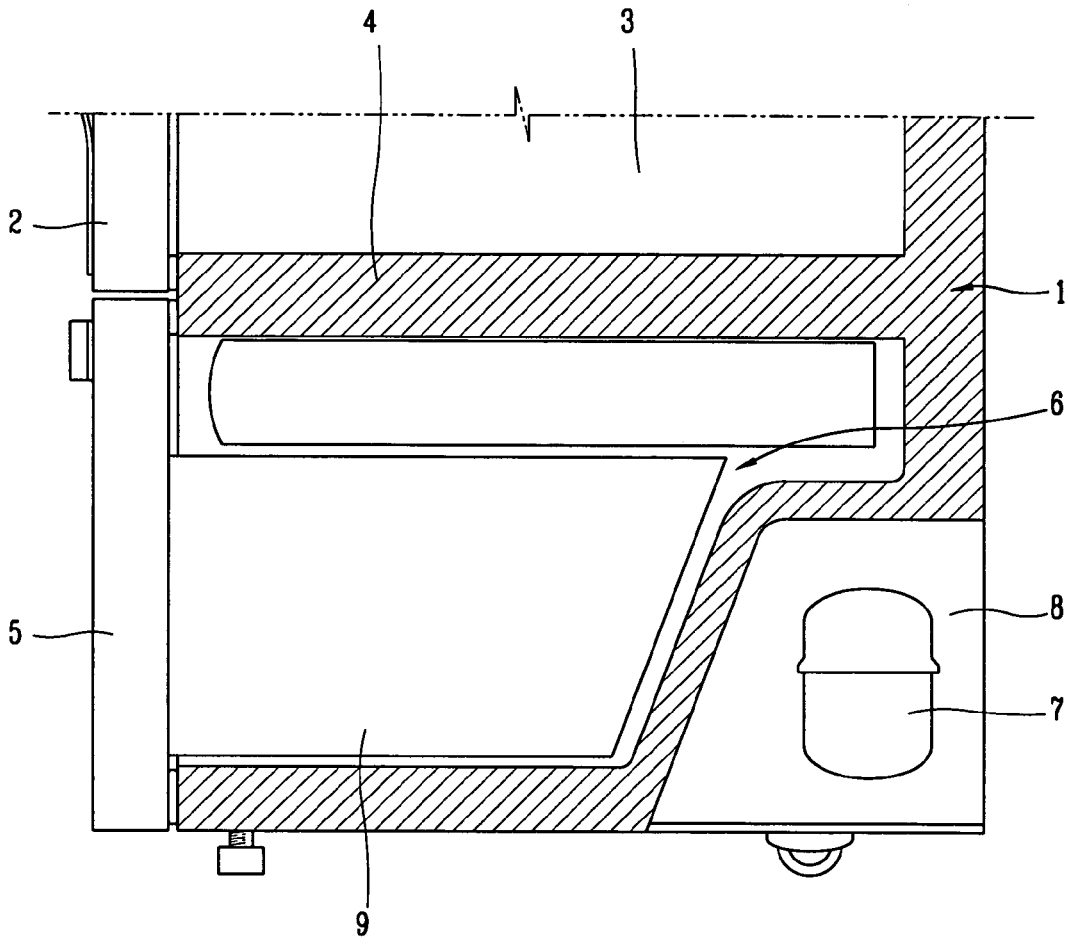
FIG. 2 CONVENTIONAL ART
FIG. 2 is a sectional view of a lower portion of the refrigerator in accordance with the conventional art.
Figure 3:
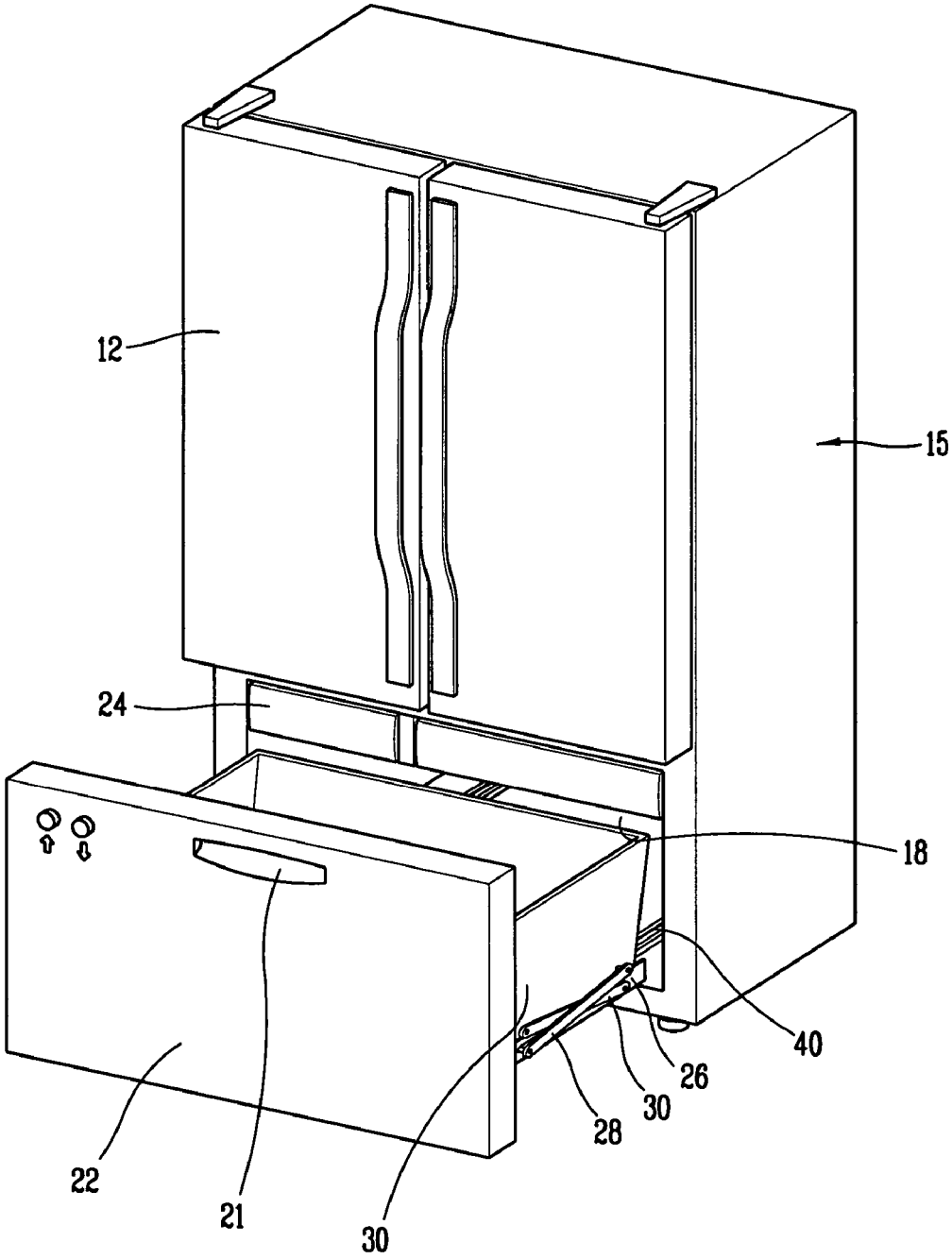
FIG. 3 is a perspective view of a refrigerator in accordance with a first embodiment of the present invention.
Figure 4:
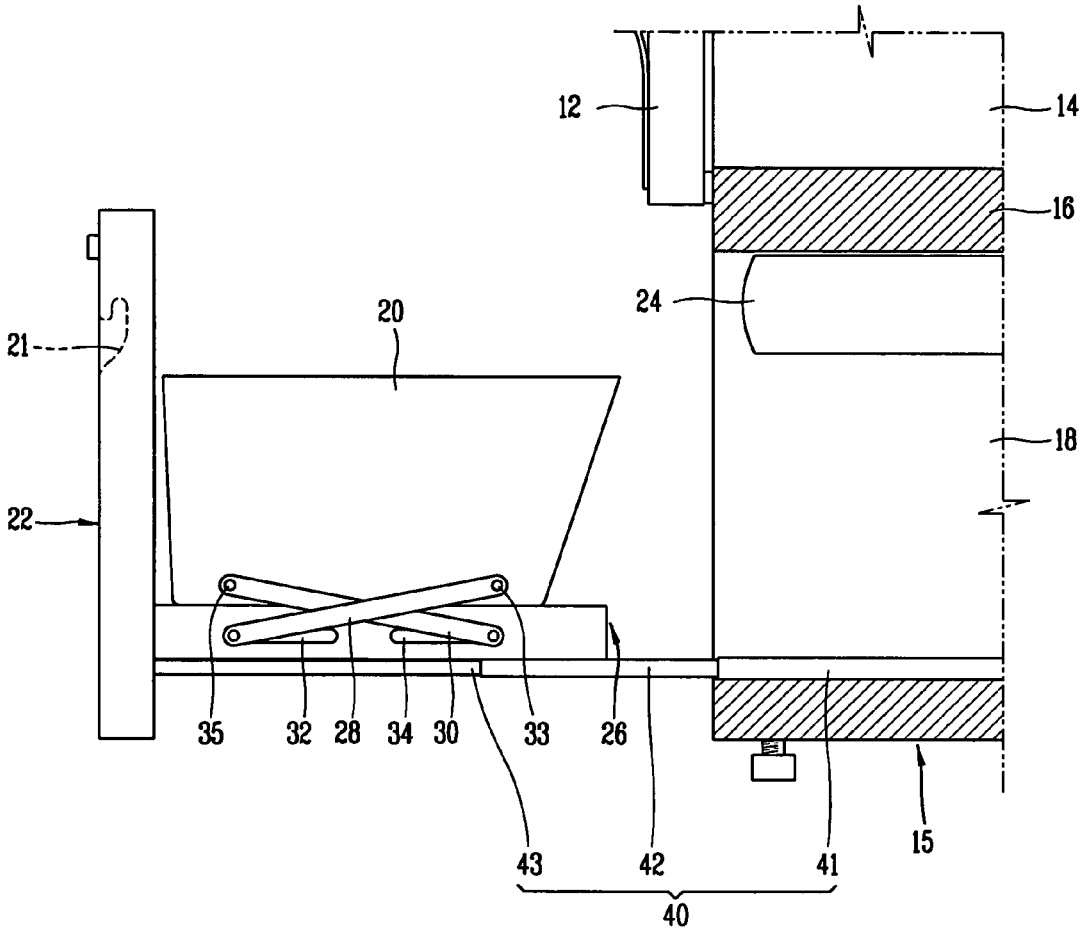
FIG. 4 is a sectional view showing a basket lift apparatus in accordance with the first embodiment of the present invention.

FIG. 3 is a perspective view of a refrigerator in accordance with a first embodiment of the present invention, and FIG. 4 is a side view of a basket lift apparatus in accordance with the first embodiment of the present invention.

The refrigerator in accordance with the present invention includes: a refrigerator body 15 having cooling chambers; a frame 26 slidingly received in a cooling chamber disposed at a lower portion of the body 15; a basket 20 put on the frame 26 and storing food items; a lower door 22 positioned at the front of the frame 26 and integrally connected to the frame 26; a first link 28 whose one side is rotatably connected to the basket 20 and the other side is slidably coupled with the frame 26; a second link 30 disposed across the first link 28, whose one side is rotatably connected to the basket 20 and the other side is slidably coupled with the frame 26; and a link drive unit (not shown) connected to the first link 28 or the second link 30 and driving the link to allow the basket 20 to ascend with respect to the frame 26.

The body 15 includes: an upper cooling chamber 14 disposed at its upper portion and provided with a pair of upper doors 12 opened in both directions, and a lower cooling chamber 18 separated from the upper cooling chamber 14 by a partition wall 16 and disposed at a lower portion of the body 15.

Preferably, the upper cooling chamber 14 is used as a refrigerating chamber for storing chilled food items, and the lower cooling chamber 18 is used as a freezing chamber for storing frozen food items.

A lower door 22 is disposed at the front of the lower cooling chamber 18 and is moved in a front and rear direction of the body 15 such that the basket 20 is taken out of or put into the lower cooling chamber 18. And, a plurality of drawers 24 storing food items and put in or taken out in a front and rear direction are disposed at an upper side of the lower cooling chamber 18. A machine room (not shown) that can receive a compressor and the like may be disposed at one side in the lower cooling chamber 18.

The lower door 22 has a handle 21 at its front so that a user can hold and pull the lower door 22. An operation switch 55 is installed at one side of the handle 21 and can be operated to allow the basket 20 to ascend when the basket is taken out.

The first link 28 is formed in a bar type having a certain length and is disposed inclined at a certain angle. One end of the first link 28 is slidably coupled with a first rail portion 32 formed at a lower end of the frame 26, and its other end is hingedly connected to a shaft 33 formed at a lower end of the basket 20.

Like the first link 28, the second link 30 is formed in a bar type having a certain length. One end of the second link 30 is slidably coupled with the second rail portion 134 formed at a lower end of the frame 26 and its other end is hingedly connected to a shaft 35 formed at a lower end of the basket 20.

The frame 26 is formed as a quadrangular box shape having a space where the basket 20 can be placed.

Two guide rails 40 along which the frame 26 slides in a front and rear direction are installed between a lower surface of the frame 26 and a bottom of the lower cooling chamber 18.

Each guide rail 40 includes: a fixed rail 41 fixed on a bottom of the lower cooling chamber 18; a middle rail 42 slidably connected with the fixed rail 41; and a moving rail 43 slidably connected with the middle rail 42 and fixed on a bottom surface of the frame 26.

Figure 5:
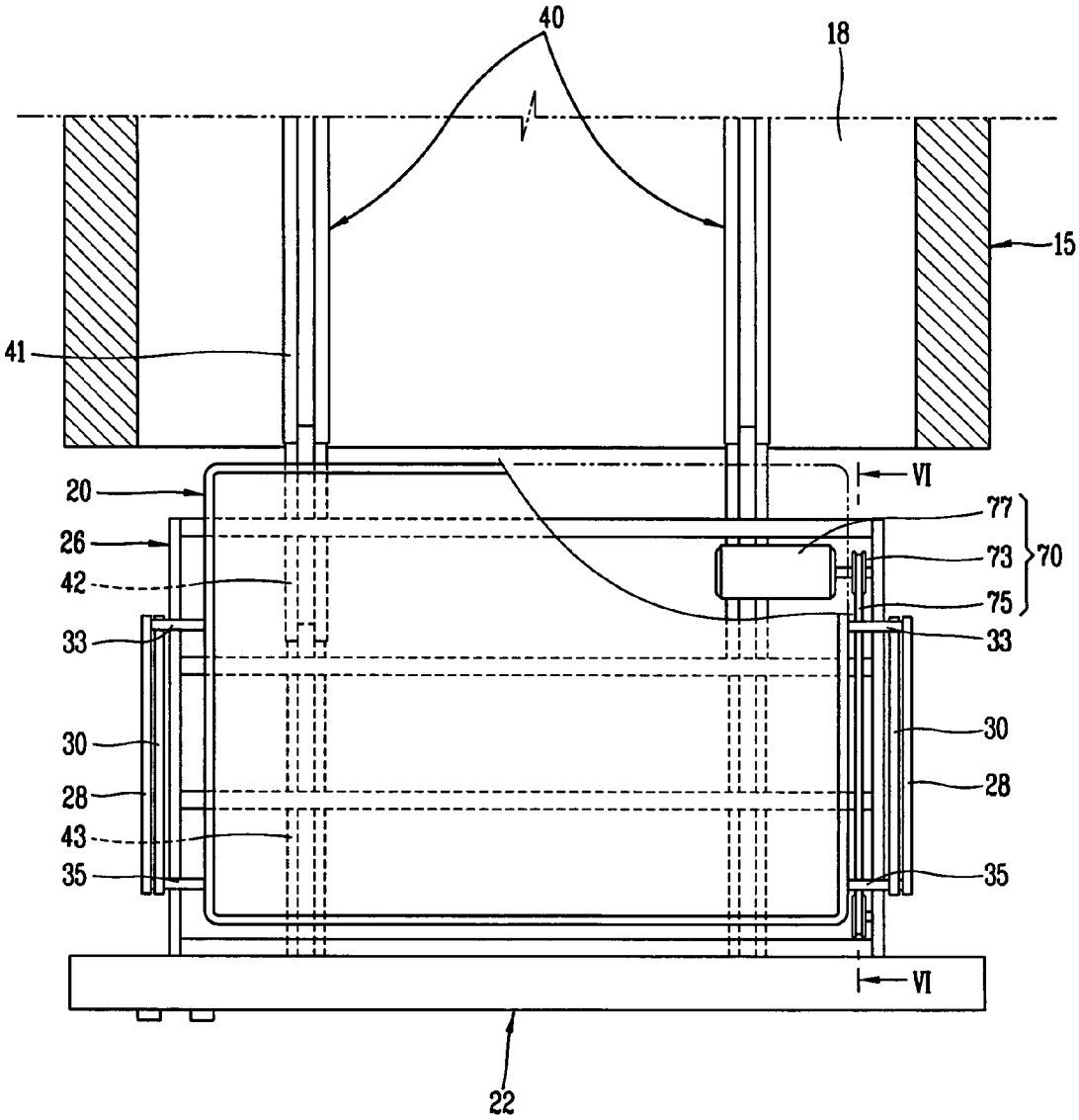
FIG. 5 is a cross sectional view of a link drive unit in accordance with the first embodiment of the present invention.
Figure 6:
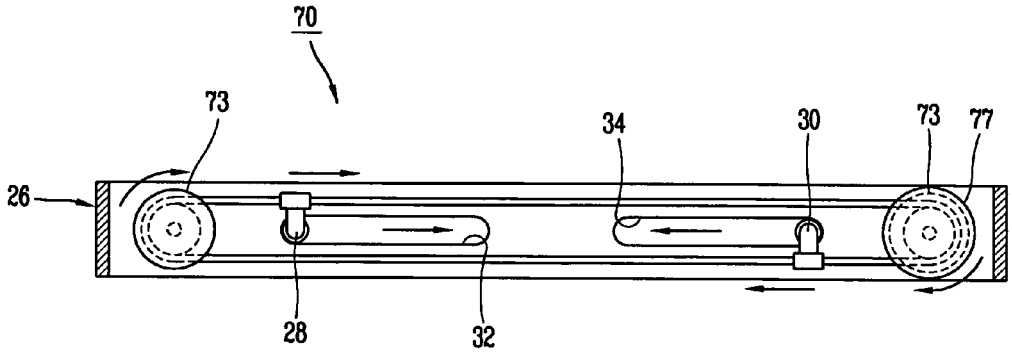
FIG. 6 is a sectional view taken along line VI-VI of FIG. 5.

FIG. 5 is a cross sectional view of a link drive unit in accordance with the first embodiment of the present invention, and FIG. 6 is a sectional view taken along line VI-VI of FIG. 5.

As shown, the link drive unit 70 includes a pair of pulleys 73 disposed at both edges of the frame 26 along a direction in which the frame 26 moves, and separated from each other at a predetermined distance; a belt 75 movably coupled with a pair of pulley 73; and a driving motor 77 for moving the belt 75.

A driving motor 77 for rotating the pulley 73 forward or backward is installed at a pulley 73 disposed at the rear, one of a pair of pulleys 73.

A lower end of the first link 28 is integrally and movably coupled with a lower surface of the belt 75. And a lower end of the second link 30 is integrally and movably coupled with an upper surface of the belt 75 such that the second link 30 can move in an opposite direction to a moving direction of the first link when the belt 75 runs.

In the present embodiment, the basket may be slid by a sprocket and a chain, instead of the pulley 73 and the belt 75.

Also, in the present embodiment, lower ends of the first link 28 and the second link 30 are slidably coupled with the frame, and their upper ends are rotatably coupled with the basket. However, upper ends of the first link 28 and the second link 30 may be slidably coupled with the basket, and their lower ends may be rotatably coupled with the frame.

The operation and effects of the present invention will now be described.

Figure 7:
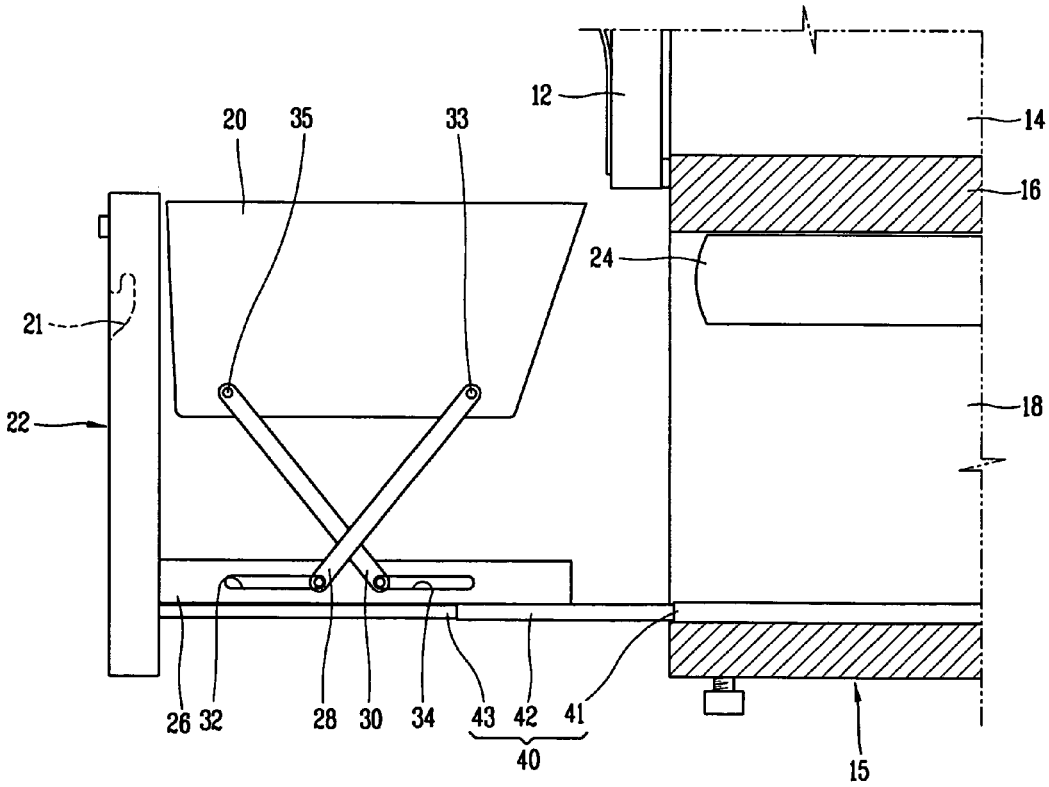
FIG. 7 is a view showing operation of the basket lift apparatus in accordance with the first embodiment of the present invention.

FIG. 7 is a view showing the operation of the basket lift apparatus in accordance with the first embodiment of the present invention.

As shown, when putting and/or taking out food items into from the basket 20, the user holds and pulls the handle 21 frontward. Then, the rail is extended, thereby allowing the frame 26 and the lower door 22 to be taken out frontward.

When intending to lift up the basket 20, the user inputs a signal with the operation switch 55. A control unit (not shown) having received the inputted signal controls the driving motor 77 to thereby rotate the driving motor 77 so that lower ends of the first link 28 and the second link 30 approach each other. When the pulley 73 begins to rotate integrally with the driving motor 77, the belt 75 runs, allowing the lower ends of the first link 28 and the second link 30 to slide along the first rail portion 32 and the second rail portion 34. When the lower ends of the first link 28 and the second link 30 move in a direction that the two approach each other, upper ends of the first link 28 and the second link 30 ascend vertically. Accordingly, the basket 20 ascends, being separated from the basket 20.

Meanwhile, when the operation switch 55 is operated after the food items are completely received in and/or taken out of the basket 20, the driving motor 77 rotates in a direction that the lower ends of the first link 28 and the second link 30 recede from each other. Thus, the basket 20 descends, getting near to the frame 26. After the descending of the basket 20 is completed, the user holds and presses the handle 21 rearward, so that the guide rail 40 is shortened. Then, the frame 26 and the basket 20 are received in the lower cooling chamber 18, and the lower door 22 blocks a front aperture of the lower cooling chamber 18.

Figure 8:
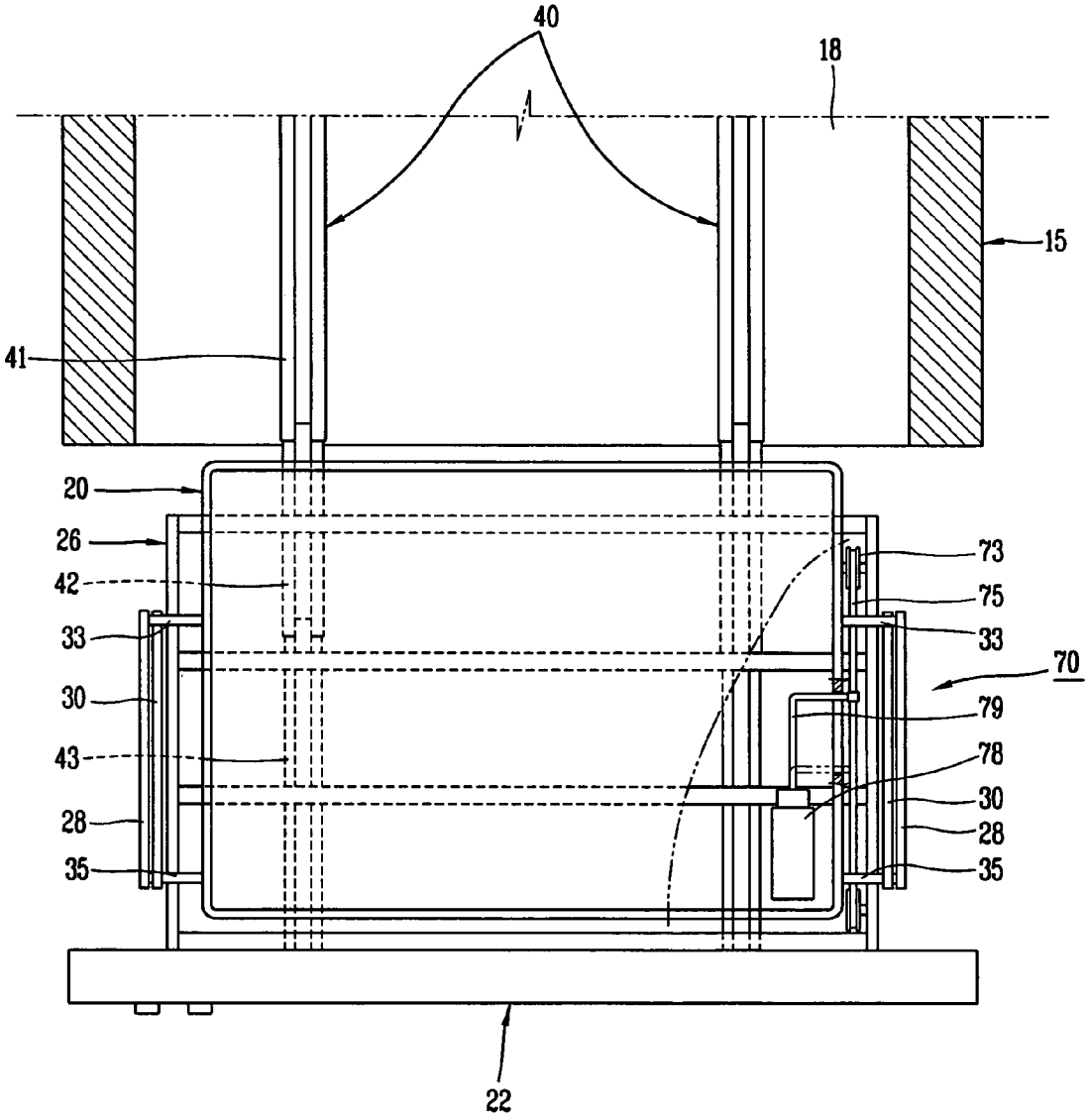
FIG. 8 is a cross sectional view showing a link drive unit in accordance with a second embodiment of the present invention.

FIG. 8 is a cross sectional view showing a link drive unit in accordance with a second embodiment of the present invention. The same reference numerals designate the same part as those of the first embodiment, and the detailed descriptions thereon will be omitted.

As shown, the link drive unit 70 can move along a direction that the frame 26 moves and include a solenoid 78 provided with a rod 79 whose one side is integrally connected with the belt 75. Namely, the rod 79 is moved forward or backward as an electric signal is supplied to the solenoid 78, thereby driving the belt 75. The solenoid 78 is used for the driving motor.

Figure 9:
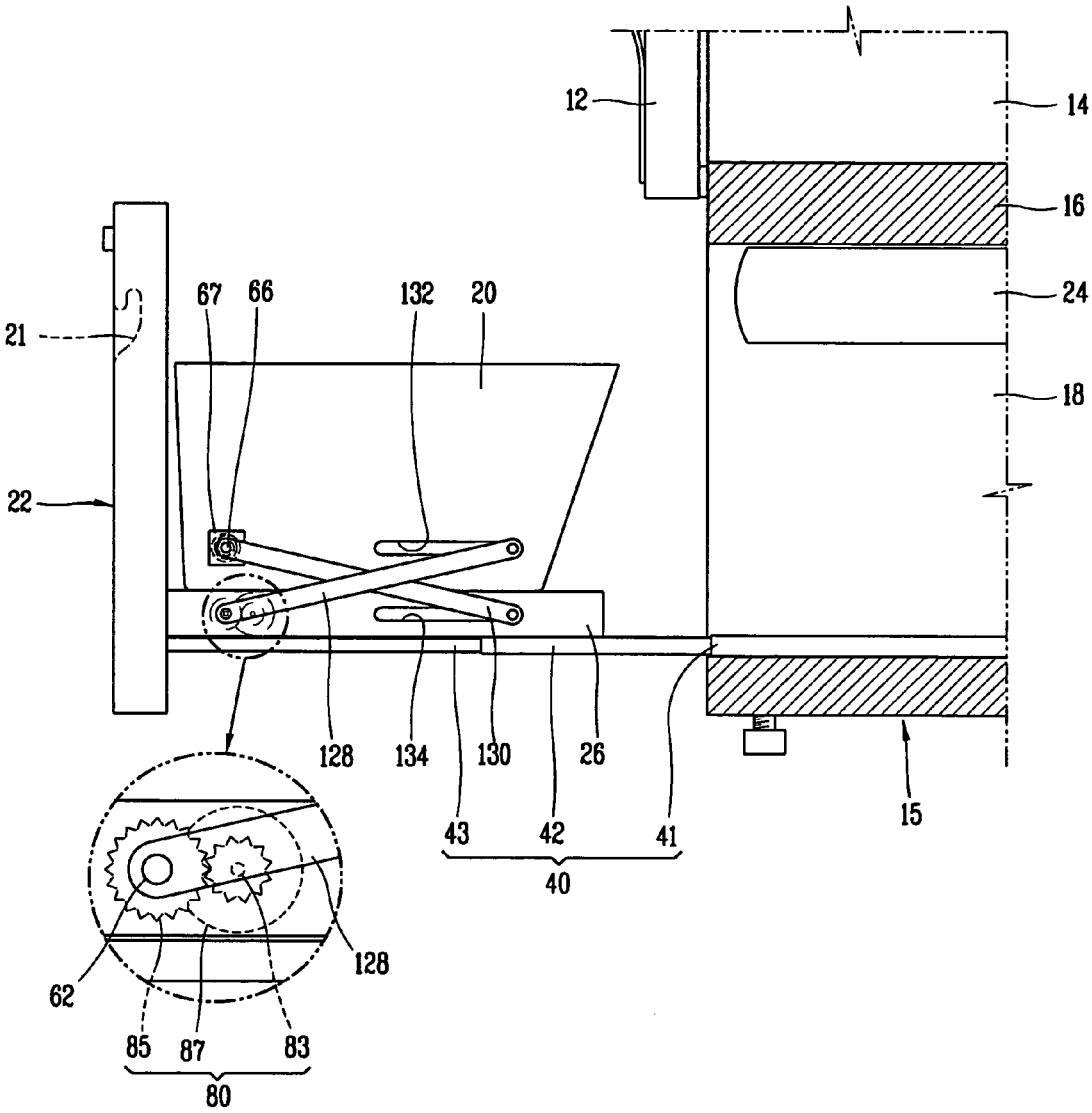
FIG. 9 is a side view of a basket lift apparatus in accordance with a third embodiment of the present invention.
Figure 10:
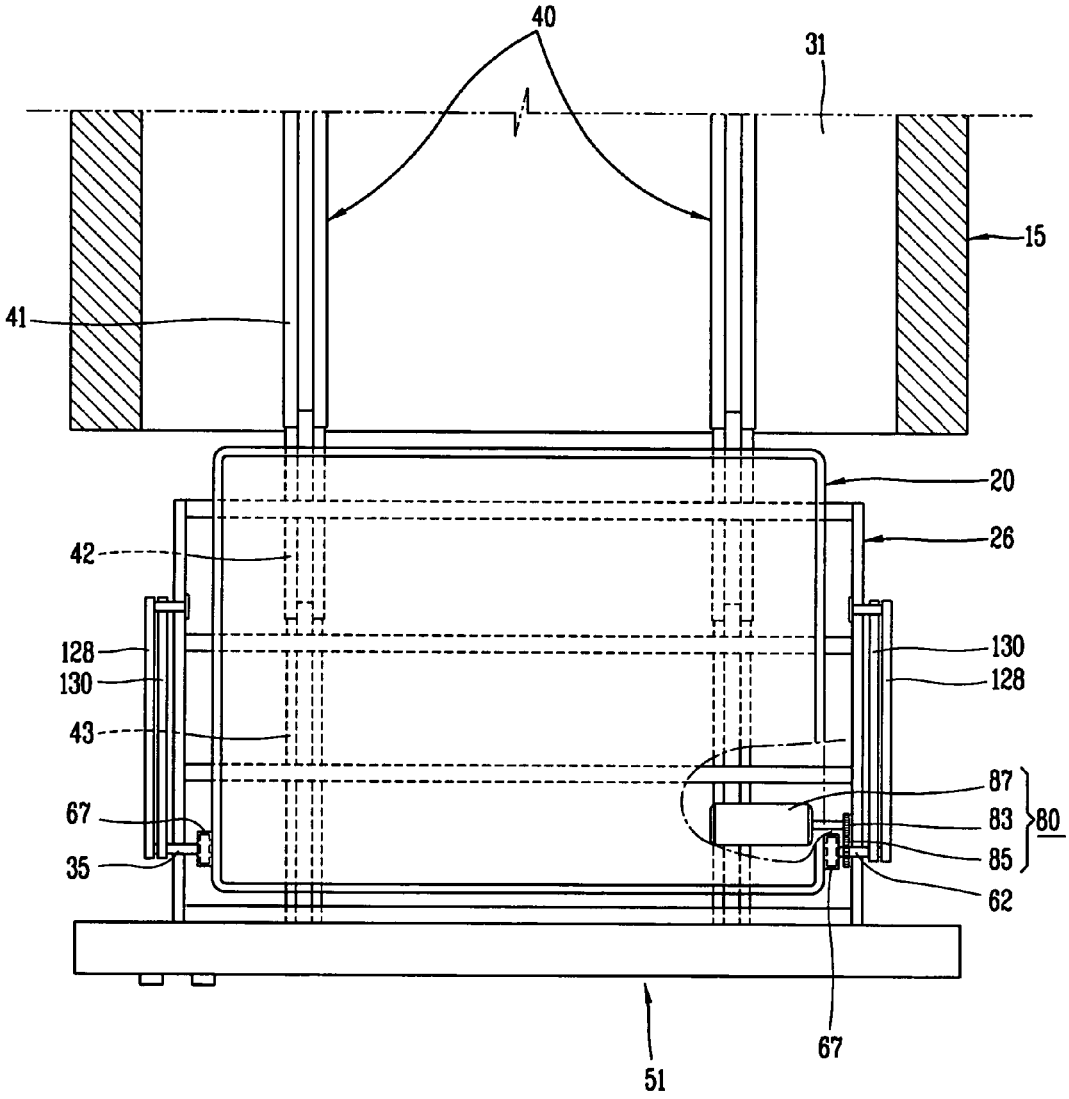
FIG. 10 is a cross sectional view showing a link drive unit in accordance with the third embodiment of the present invention.

FIG. 9 is a side view of a basket lift apparatus in accordance with a third embodiment of the present invention, and FIG. 10 is a cross sectional view of a link drive unit in accordance with the third embodiment of the present invention. The same reference numerals designate the same part as those of the first embodiment, and the detailed descriptions thereon will be omitted.

As shown, one side of a first link 128 is rotatably coupled with the frame 26, and the other side is slidably coupled with the basket 20.

A second link 130 is disposed across the first link 128. One side of the second link 130 is slidably coupled with the frame 26, and its other side is rotatably coupled with the basket 20.

One side of the first link 128 is rotatably coupled with one side of the frame 26, and a fourth rail portion 134 is formed at the other side of the frame 26 so that one side of the second link 130 can slide therealong in a direction that the frame 26 moves.

A third rail portion 132 along which the other side of the first link 128 slides is formed at one side of the basket 20, and the other side of the second link 130 is rotatably coupled with the other side of the basket 20 by a shaft 66.

The shaft 66 is provided with a link spring 67 for applying an elastic force in a direction that the second link 130 rotates to lift up the basket 20.

The link spring 67 provides an elastic force which makes the first link 128 stand. When the basket 20 ascends, the link spring 67 provides an elastic force thereto, thereby facilitating the ascent of the basket 20. Preferably, the link spring 67 is a spiral spring or a torsion spring.

The link drive unit 80 includes: a gear motor 85 integrally and rotatably coupled with a shaft 62 formed at a lower end of the first link 128; a gear 83 engaged with the gear motor 85; and a driving motor 87 integrally coupled with the gear 83 and rotating the gear 83.

Although an upper end of the first link 128 and a lower end of the second link 130 slide and a lower end of the first link 128 and an upper end of the second link 130 rotatably coupled with the frame 26 and the basket 20, respectively, in the present embodiment, the opposite construction may be employed.

Also, the shaft 62 formed at the lower end of the first link 128 is rotated by using the driving motor 87 in the present embodiment. However, an upper end of the second link 130 may be rotated, or an upper end of the first link 128 and/or a lower end of the second link may be slid by using a driving motor, a solenoid or the like.

The operation of the third embodiment of the present invention having such a structure will now be described.

Figure 11:
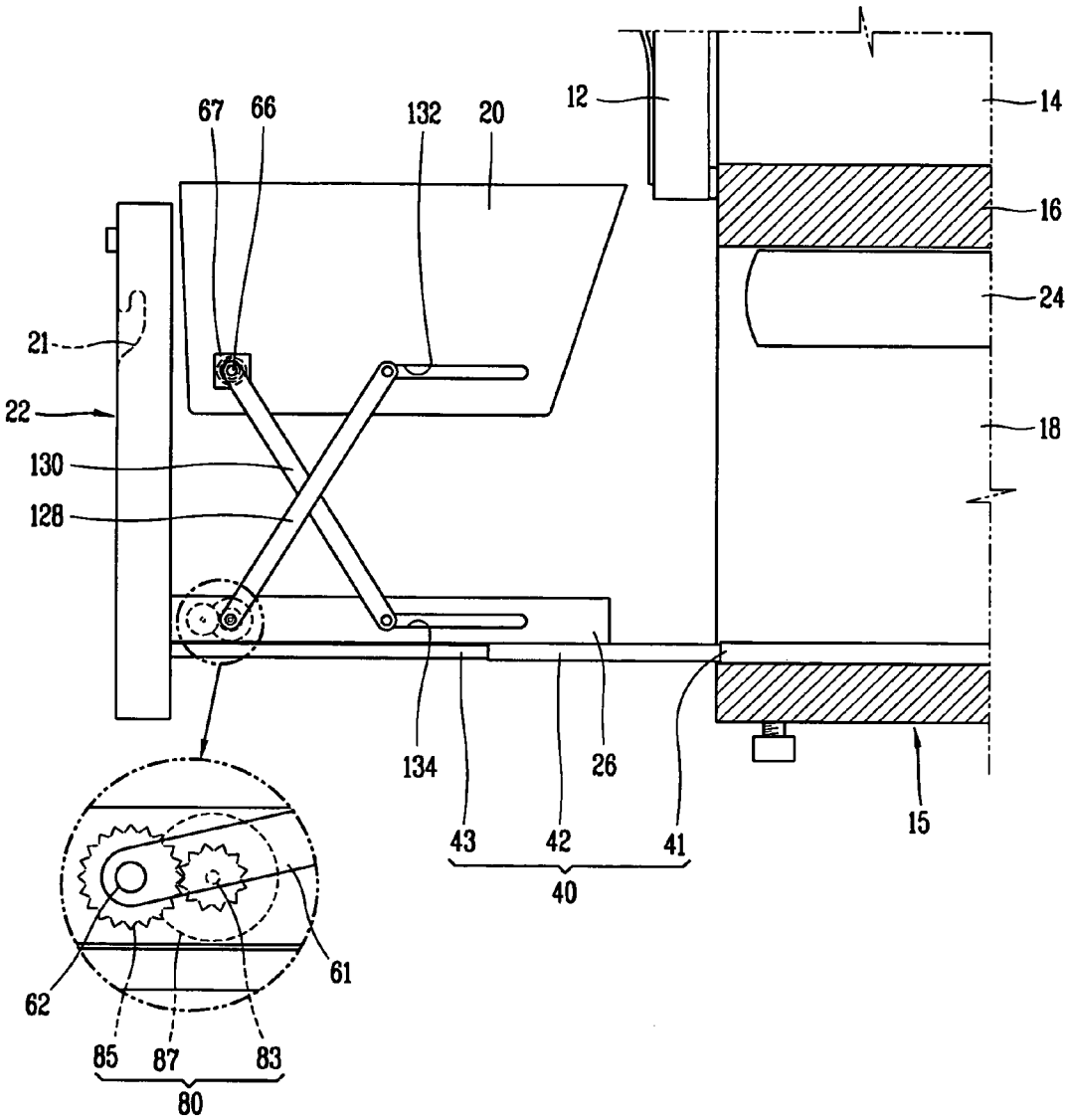
FIG. 11 is a view showing operation of the basket lift apparatus in accordance with the third embodiment of the present invention.

FIG. 11 is a view showing operation of the basket lift apparatus in accordance with the third embodiment of the present invention.

As shown, when intending to move the basket 20 upwards in a state that the basket 20 has been taken out, a user operates an operation switch 55 disposed outside the lower door 22. The link driving motor 87 rotates to rotate the first link upwardly, and thus the basket 20 moves upwardly with respect to the frame 26. In order to lift up the basket 20, the lower end of the second link 130 moves along a fourth rail portion 134. At this time, the link spring 67 applies an elastic force to the second link 130, thereby facilitating the ascent of the basket 20.

Meanwhile, when the operation switch 55 is operated so as to move the basket 20 downward, the link driving motor 87 rotates to rotate the first link 128 downwardly. Accordingly, the upper end of the first link 128 and the lower end of the second link 130 slide to the rear areas of the basket 20 and the frame 26, respectively, and the basket 20 descends to come in contact with and be supported by the frame 26.

Figure 12:
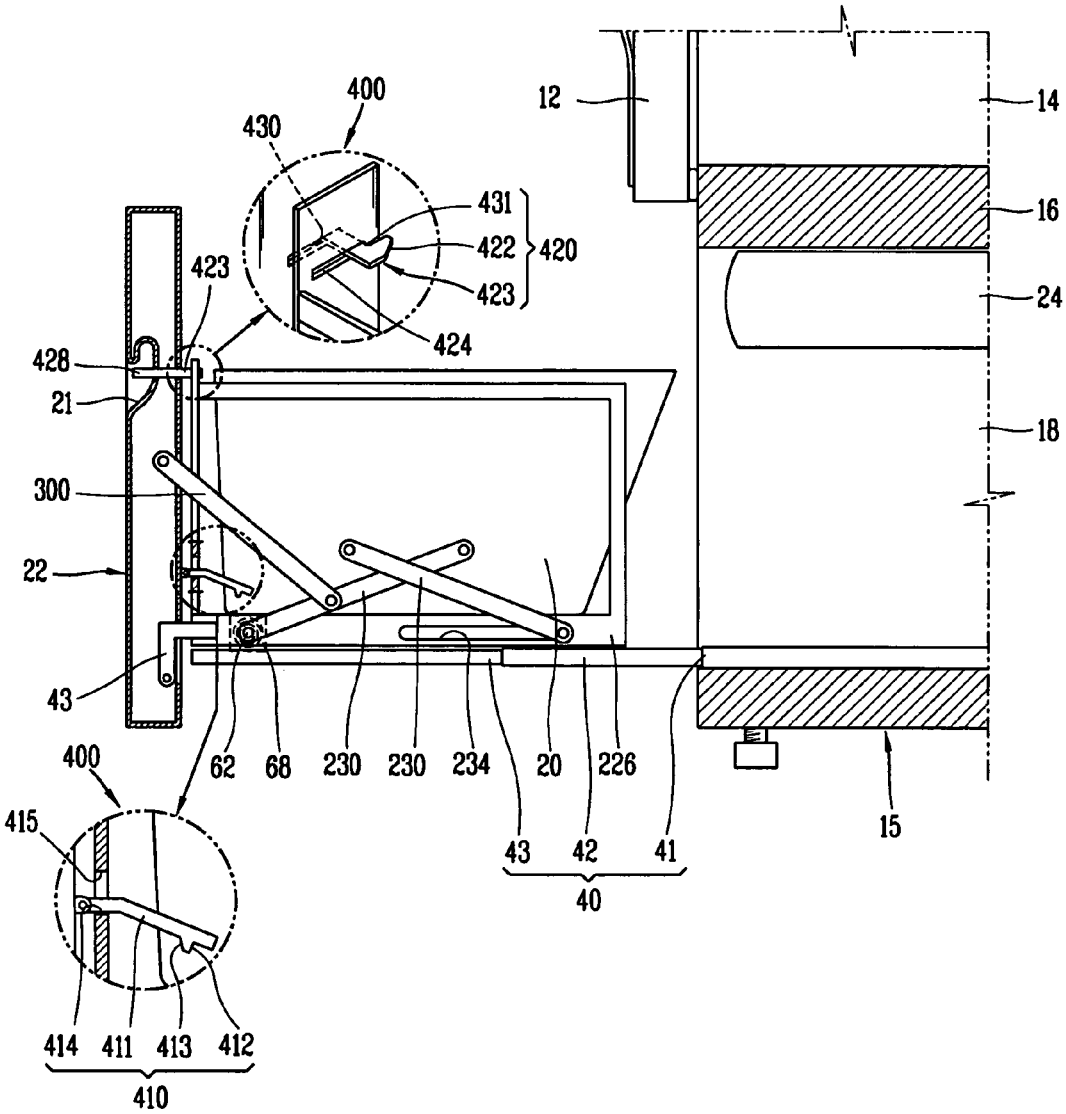
FIG. 12 is a side view of a basket lift apparatus in accordance with a fourth embodiment of the present invention.
Figure 13:
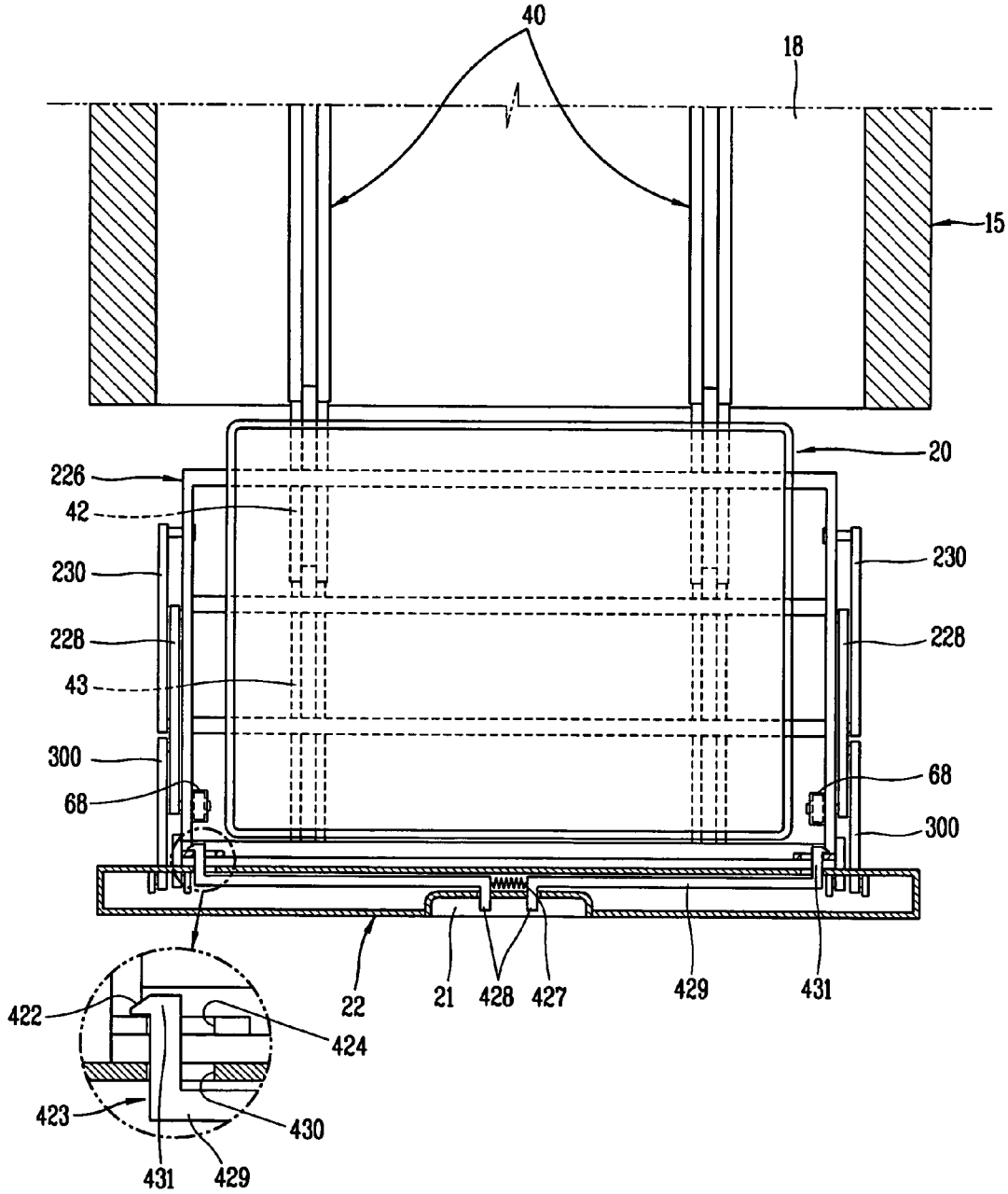
FIG. 13 is a cross sectional view of a link drive unit in accordance with the fourth embodiment of the present invention.

FIG. 12 is a side view of a basket lift apparatus in accordance with a fourth embodiment of the present invention, and FIG. 13 is a cross sectional view of a link drive unit in accordance with the fourth embodiment of the present invention. The same reference numerals designate the same part as those of the first embodiment, and the detailed descriptions thereon will be omitted.

A refrigerator in accordance with the present invention includes: a refrigerator body 15 having cooling chambers; a frame 226 slidingly received in a cooling chamber disposed at a lower portion of the body 15; a basket 20 put on the frame 226 and storing food items; a lower door 22 positioned at the front of the frame 226 and rotatably connected with the frame 226; a first link 228 whose one side is rotatably coupled with the frame 226 and the other side is rotatably coupled with the basket 20; a second link 230 disposed across the first link 228, whose one side is rotatably coupled with the basket 20 and the other side is slidably coupled with the frame 226; a connection link 300 whose one side is connected with the lower door 22 and the other side is connected to the first link 228; and a fixing unit 400 installed at the lower door 22 and fixing the lower door 22 at a specific position.

A hinge portion 143 is formed at a lower portion of the lower door 22 and is rotatably supported thereby.

A lower end of the first link 228 is rotatably connected to a front area of the frame, and a link spring 68 is connected to a shaft 62 formed at a lower end of the first link 228 so that the link 228 can rotate, moving the basket 20 upwards. Also, a rail portion 234 along which a lower end of the second link 230 slides in a front and rear direction is formed at a rear area of the frame 226.

One end of the connection link 300 is rotatably connected to the lower door 22, and its other end is rotatably connected to a specific place.

The fixing unit 400 includes: a first door fixing unit 410 formed at a rear surface of the lower door 22 and allowing the lower door 22 to remain in a downwardly-rotated (i.e., opened) state as the basket 20 ascends; and a second door fixing unit 420 allowing the lower door 22 to remain perpendicular to the frame 226 as the basket 20 descends.

The first door fixing unit 410 includes: a rod 411 having a certain length and rotatably connected to a rear surface of the lower door 22 by a shaft 414; a stopping hole 415 formed at the frame 226 such that the rod 411 passes therethrough; and a catching protrusion 412 formed at an end of the rod 411 and getting caught in the stopping hole 415. Here, the rod 411 preferably has an inclined portion 413 so that the rod 411 can easily pass through the stopping hole 415 when the lower door 22 rotates.

Such a first door fixing unit 410 can allow the lower door 22 to maintain a current state since the rod 411 passes through the stopping hole 415 as the lower door 22 rotates and the catching protrusion 412 formed at an end portion of the rod 411 gets caught in the stopping hole 415 when the lower door 22 rotates as much as possible.

The second door fixing unit 420 includes: a locking hook 423 linearly movably mounted to the lower door 22; a locking hole 424 formed at an upper end of the front of the frame 226, in which the locking hook 423 is locked; and a spring 427 providing an elastic force to the locking hook 423 in a direction that the locking hook 423 is locked in the locking hole 424.

The locking hook 423 includes: an operation portion 428 disposed at a handle 21 of the lower door 22 and operated by a user; a rod portion 429 integrally connected with the operation portion 428 and linearly movably disposed inside the lower door 22; and a locking portion 431 formed at an end portion of the rod portion 429, passing through a through hole 430 formed at a rear surface of the lower door 22 to be exposed outside the rear of the lower door 22, and locked in the locking hole 424. A guide inclined surface 422 is formed at one side of the locking portion 431 for the purpose of smooth contact with the locking hole 424.

Two locking hooks 423 are formed as a pair and disposed at right and left sides of the lower door 22, respectively. And a spring 427 is disposed between said pair of operation portions 428.

When the user presses an operation portion 428, the rod portion 429 is linearly moved and the locking portion 431 is separated from the locking hole 424, so that the locking of the lower door 22 by the second door fixing unit 420 is released.

Although the basket 20 is lifted up by a pulling force of the lower door 22 and an elastic force of the link spring 68 in the present embodiment, the basket 20 may be lifted up only by the pulling force of the lower door 22 or by a rotation force of a driving motor. Also, the basket 20 may be lifted up by a rotation force of the driving motor and the elastic force of the link spring 68 that work at the same time.

The operation of the basket lift apparatus in accordance with the fourth embodiment of the present invention having such a structure will now be described.

Figure 14:
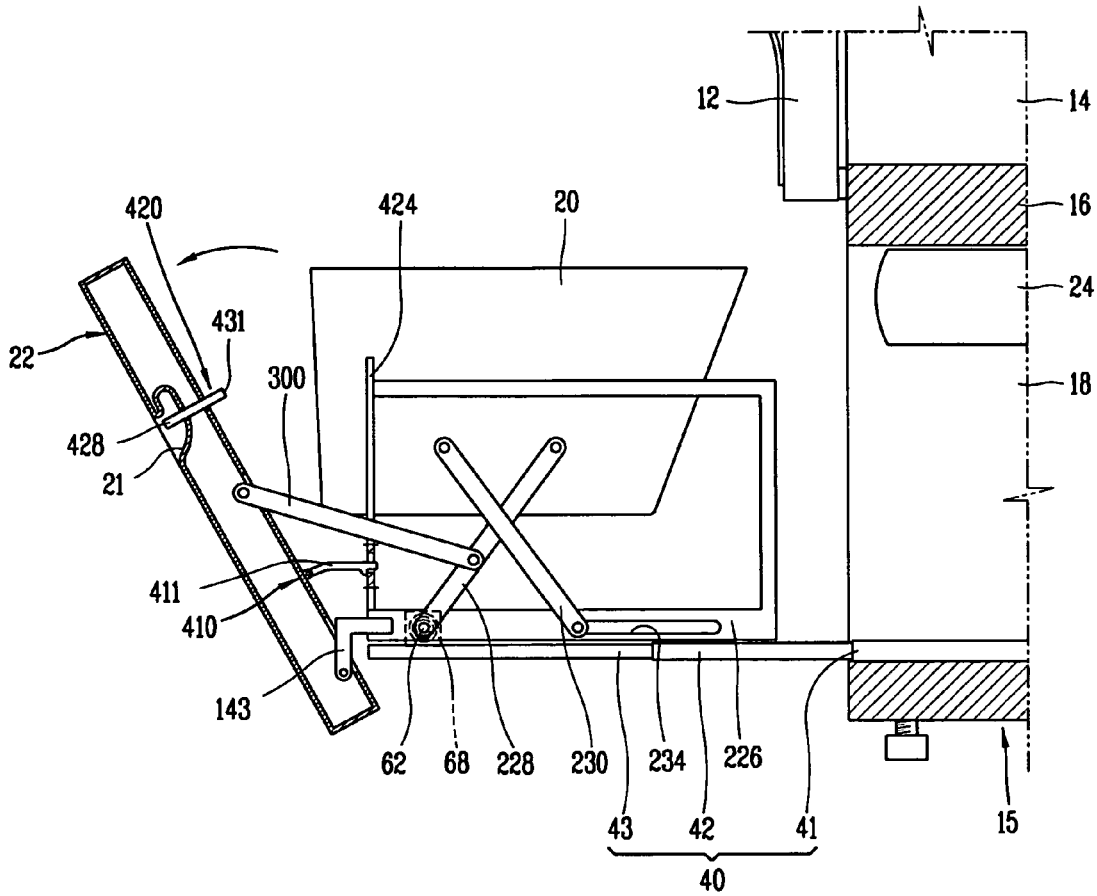
FIG. 14 is a view showing operation of the basket lift apparatus in accordance with the fourth embodiment of the present invention.

FIG. 14 is a view showing operation of the basket lift apparatus in accordance with the fourth embodiment of the present invention.

When a user holds and pulls a handle 21 of the lower door 22, the frame 226 is slid along the guide rail 40 to thereby be taken out from the lower cooling chamber 18. At this time, the basket 20 put on the frame 226 is exposed to the outside.

In such a state, if the user operates the second door fixing unit 420, the locking between the lower door 22 and the frame 226 is released. Namely, when the user presses the operation portion 428 of the locking hook 423, the locking portion 431 comes out of the locking hole 424 formed at the frame 226. Accordingly, the locking of the lower door 22 is released.

And, when the lower door 22 is rotated toward the front, a four-linkage mechanism which is hingedly connected between the lower door 22, the frame 226 and the basket 20 is operated to lift up the basket 20. Namely, when the lower door 22 is rotated, the first link connected to the lower door 22 by the connection link 300 is rotated together with the lower door 22, and the second link 230 hingedly connected between the basket 20 and the frame 226 is placed upright by the rotation of the first link 228, thereby lifting up the basket 20.

At this time, the basket 20 is more easily lifted up by an elastic force of the link spring 68 mounted to the first link 228, which makes the operation of a user easy. And, when the basket 20 is lifted up as much as possible, the first door fixing unit 410 mounted between the lower door 22 and the basket 20 is operated, thereby preventing the lower door 22 from returning back to an original position and thus allowing the basket 20 to remain lifted.

In contrast, when intending to move the basket 20 down, the user releases the locking of the first door fixing unit 410 and then presses the basket 22 downwards. Then, the basket 20 is put on the frame 26.

Effects of the refrigerator having a basket lift apparatus in accordance with the present invention constructed and operated as above will now be described.

The user's convenience can be improved as the basket is lifted up by rotation of the lower door after the basket is taken out of the lower cooling chamber.

Also, since the basket is automatically lifted up when the user presses a switch after taking the basket outside, the user can more conveniently use the refrigerator.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a body having a cooling chamber;

a frame received in the cooling chamber and provided with a door for opening and closing the cooling chamber;

a basket positioned on the frame for storing food; and a basket lift apparatus installed between the frame and the basket for lifting the basket;

wherein the basket lift apparatus comprises:

a first link rotatably connected to the basket and slidably connected to the frame;

a second link arranged to cross the first link, rotatably connected to the basket, and slidably connected to the frame; and a driving unit connected to at least one of the first link and the second link for lifting the basket on the basis of the frame.

2. The refrigerator of claim 1, wherein the frame is connected to the inside of the cooling chamber by a guide rail and moved in back and forth directions of the body.

3. The refrigerator of claim 1, wherein a switch for operating the basket lift apparatus is installed at a front surface of the door.

4. The refrigerator of claim 1, wherein the first link has one end rotatably connected to a front lower portion of the basket, and another end slidably coupled to a second rail portion formed at a rear side of the frame in a longitudinal direction.

5. The refrigerator of claim 1, wherein the second link has one end rotatably connected to a rear lower portion of the basket, and another end slidably coupled to a first rail portion formed at a front side of the frame in a longitudinal direction.

6. The refrigerator of claim 1, wherein the driving unit comprises:

a pair of pulleys rotatably mounted at both ends of the frame;

a belt wound between the pair of pulleys;

a driving motor connected to one of the pair of pulleys for rotating the pulley; and a connecting member for connecting at least one of the first link and the second link to the belt.

7. The refrigerator of claim 6, wherein the connecting member comprises:

a first connecting member connected between the first link and one side of a belt moved in a forward direction; and a second connecting member connected between the second link and another side of a belt moved in a backward direction.

* * * * *